US005477768A

United States Patent [19]

Swift

[11] Patent Number: 5,477,768

[45] Date of Patent: Dec. 26, 1995

[54] MULTI-PURPOSE DRUM BALL JOINT SIMULATOR

[76] Inventor: Donald J. Swift, 11 Front Street, Emo, Ontario, Canada, P0W 1E0

[21] Appl. No.: 263,359

[22] Filed: Jun. 21, 1994

[30] Foreign Application Priority Data

Jul. 9, 1993 [CA] Canada ..... 2100217

[51] Int. Cl.[6] ..... G10D 13/02

[52] U.S. Cl. ..... 84/453; 84/422.4

[58] Field of Search ..... 84/422.4, 422.1, 84/453

[56] References Cited

U.S. PATENT DOCUMENTS 2,466,554 4/1949 Mossey ..... 84/422.4

2,905,043 9/1959 Soderberg ..... 84/422.4

4,649,792 3/1987 Swartzlander ..... 84/422.4

*Primary Examiner*—Patrick J. Stanzione

*Attorney, Agent, or Firm*—Murray E. Thrift; Adrian D. Battison

[57] ABSTRACT

A rubber or other elastomeric material ball is mounted on a drum stick shaft to provide a ball grip to be held in the palm of the hand as the ball of a ball and socket joint. This balances the drum stick and provides enhanced performance. The ball may also be used on the end of the stick shaft as a mallet conversion of the stick.

11 Claims, 1 Drawing Sheet

MULTI-PURPOSE DRUM BALL JOINT SIMULATOR

FIELD OF THE INVENTION

The present invention relates to an accessory device for use with drum sticks and to drum sticks equipped with the accessory device.

BACKGROUND

In order to enhance the grip on the shaft of a drum stick, it is common for drummers to use tape and various wraps to add grooves to the shaft. However, tape and other wraps can make a stick awkward, sticky and cumbersome so that it is difficult to handle proficiently. Powders are used to reduce sweating of the palms to prevent stick slippage. Powders are however, a messy, non-reusable accessory.

The present invention relates to an alternative mechanism for grip improvement and enhanced stick control.

SUMMARY

According to one aspect of the present invention there is provided a drum stick accessory for a drum stick having an elongate shaft, said accessory comprising a ball, a diametral hole through the ball dimensioned to receive the shaft of the drum stick therethrough.

According to another aspect of the present invention there is provided a drum stick having the ball installed on the shaft thereof.

The ball is preferably a solid sphere of resilient, elastomeric material. The hole is somewhat smaller in diameter than the stick shaft so that when the ball is mounted on the shaft of the stick there is a frictional engagement holding the ball in place.

The drum stick can be viewed as an extension from the drummer to the drum, an extra appendage in the nature of an artificial limb. In order to maximize the performance of this extra limb, a joint is required, somewhat like the ball and socket joints found in human limbs. When using the ball accessory, the drum stick acts as a limb, and the palm and fingers represent a socket engaging the ball on the stick. With the ball installed, technique is enhanced by providing stick balance and control along with increased comfort.

In preferred embodiments, the ball has a barrel-shaped hole, with a diameter that reduces from the center of the ball towards the ends. This allows the high friction areas holding the ball in place to be limited to adjacent the ends of the hole, so that the ball is more easily installed and moved than would be the case with a smooth, uniform diameter hole.

If desired, drum sticks can be converted to mallets by installing the balls near the ends of the stick shafts. The sticks may then be held from the tips so that the balls may be used for soft cymbal work, or on timpani, steel drums, xylophones, etc. The balls may also be used as weights for warming up and/or playing exercises. Percussionists may also use more than one ball per stick according to personal preference.

BRIEF DESCRIPTION OF THE DRAWINGS

In the accompanying drawings, which illustrate an exemplary embodiment of the present invention.

DETAILED DESCRIPTION

Figure 1:
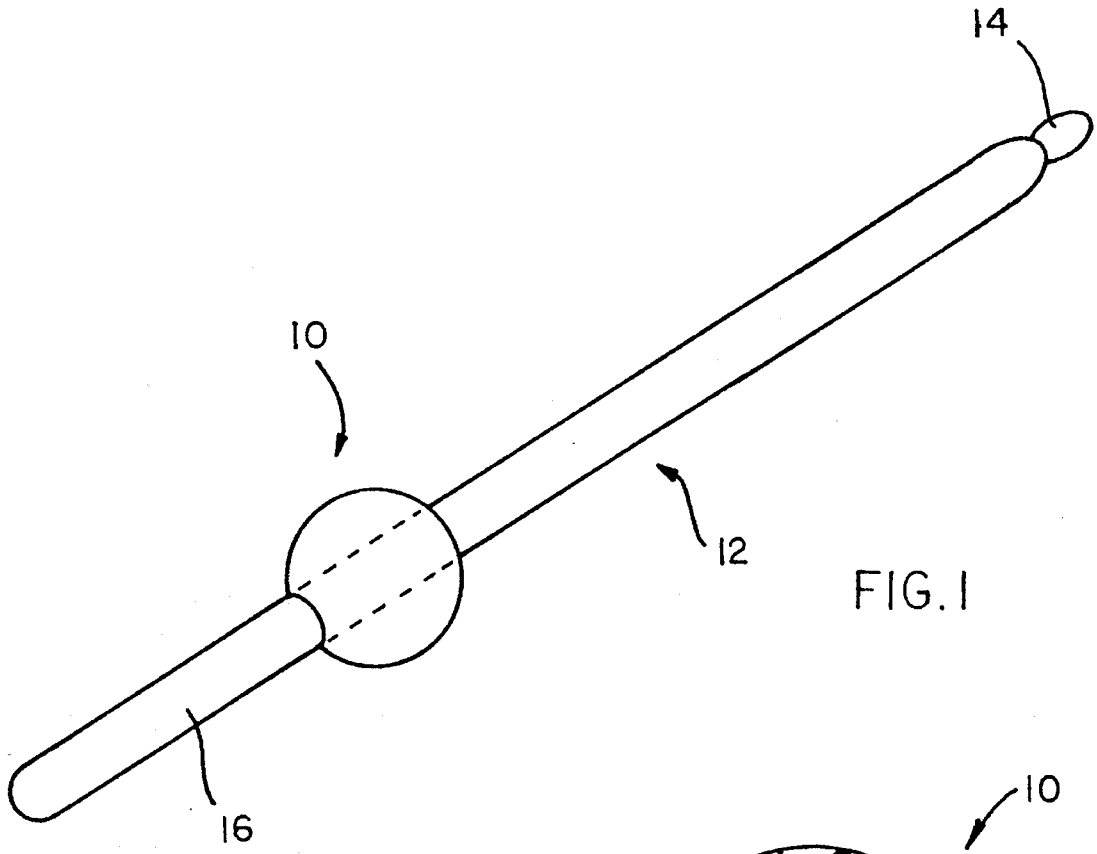
FIG. 1 is an isometric view showing a ball mounted on a drum stick shaft.

Referring to the accompanying drawings, FIG. 1 illustrates a rubber ball 10 mounted on a drum stick 12 having a tip 14 and a shaft 16. The ball is mounted part way along the shaft 16, to the preference of the user.

Figure 2:
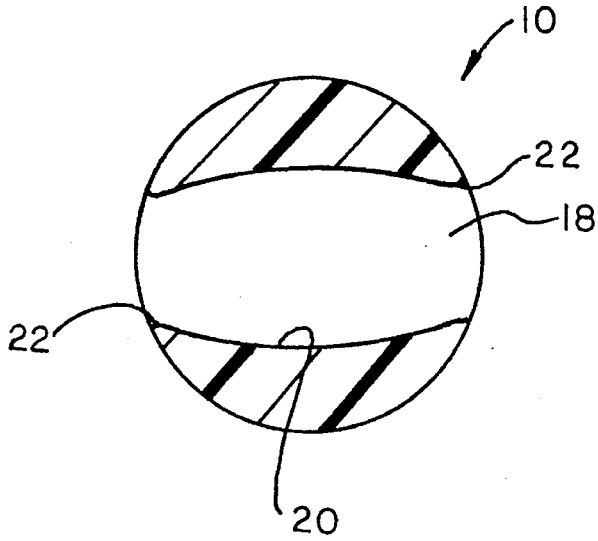
FIG. 2 is a cross section of a ball.

FIG. 2 illustrates the configuration of the ball. The ball is a sphere of solid rubber with a diametral hole 18 dimensioned to receive the drum stick shaft. The hole has a generally barrel-shaped center part 20 with a diameter that reduces from the center of the ball towards the ends, so that the end parts 22 of the hole form gripping lips for engripping the stick shaft.

To install the ball on a shaft, soap is used as a lubricant between the ball and the stick and the ball is slid onto the stick shaft to the desired location. The ball will stretch as needed to accommodate sticks of various diameters. When installed, the ball may be used for whatever purpose suits the percussionist. The primary intended purpose is to serve as a ball for control and gripping in the hand during normal drumming, and acts as a shock absorber reducing hand fatigue.

It is to be understood that tile accessory device described above may be made of rubber of any desired consistency, according to the user's preference. The diameter of the ball will also vary in accordance with personal preference. The ball can be manufactured in any color, solid or mixed. It may include a phosphorescent or fluorescent material as desired. It is also possible to vary the texture of the ball's surface to provide a coarse surface texture rather than the smooth surface illustrated in the exemplary embodiment. It is therefore to be understood that the invention is to be considered limited solely by the scope of the appended claims.

I claim:

1. A drum stick accessory for a drum stick having an elongate shaft, said accessory comprising a solid annular body of resilient material, the body having an external surface configured as a ball and having an inner annular surface configured as a continuous diametral hole through the ball, the hole being dimensioned to receive the shaft of the drum stick therethrough.

2. An accessory according to claim 1 wherein the body comprises an elastomeric material.

3. An accessory according to claim 2 wherein the diametral hole has a circular cross section.

4. An accessory according to claim 3 wherein the hole has a diameter that decreases from the center of the ball towards the end of the hole.

5. An accessory according to claim 1 wherein the ball is substantially spherical.

6. A drum stick having a shaft with a shaft diameter and an accessory mounted on the shaft, the accessory consisting of an annular body of resilient, elastomeric material and configured as a ball positioned along the shaft without loose elements unconnected to the shaft or resilient body between the shaft and the body, the ball having a diameter larger than the diameter of the shaft.

7. A drum stick according to claim 6 wherein the body is a solid body.

8. A drum stick according to claim 7 wherein the diametral hole has a circular cross section.

9. A drum stick according to claim 8 wherein the hole has a diameter that decreases from the center of the ball towards the ends of the hole.

10. A drum stick according to claim 6 wherein the ball is substantially spherical.

11. A drum stick according to claim 6 wherein the ball acts as a shock absorber.

* * * * *